US006041551A

United States Patent [19]

Aspenwall

[11] Patent Number: 6,041,551

[45] Date of Patent: Mar. 28, 2000

[54] DOOR TRACK AND ROLLER SYSTEM

[76] Inventor: John E. Aspenwall, 10314 N. 8000, West Lehi, Utah 84043

[21] Appl. No.: 08/892,326

[22] Filed: Jul. 14, 1997

[51] Int. Cl.[7] ..... E05D 13/00

[52] U.S. Cl. ..... 49/425; 49/453

[58] Field of Search ..... 49/425, 409, 453, 49/410

[56] References Cited

U.S. PATENT DOCUMENTS

| | | | |
|---|---|---|---|
| 1,444,349 | 2/1923 | Leeds . | |
| 1,509,407 | 9/1924 | MacQuarrie . | |
| 1,956,651 | 5/1934 | Moran . | |
| 2,197,385 | 4/1940 | Ricken | 49/425 |
| 2,386,510 | 10/1945 | Shafer | 49/409 |
| 3,693,293 | 9/1972 | Egan, Jr. et al. . | |
| 4,198,785 | 4/1980 | Marulic et al. | 49/425 X |
| 4,633,615 | 1/1987 | Moose . | |
| 4,833,829 | 5/1989 | Wilson . | |
| 5,488,803 | 2/1996 | George . | |

*Primary Examiner*—Daniel P. Stodola
*Assistant Examiner*—Hugh B. Thompson
*Attorney, Agent, or Firm*—M. Reid Russell

[57] ABSTRACT

A door track and roller system for a mounting a sliding door in a frame that includes, as a lower track for mounting along a lower surface of a sliding door frame, at least one section of a straight channel that has top edges of parallel side walls that are inturned at right angles to form aligned flat flanges that are open therebetween to accommodate a carriage of the sliding door traveling therebetween, and which flanges include at least one transverse slot formed therein of a length to pass a roller and axle of a carriage of a roller assembly of the sliding door therethrough. Each roller assembly carriage to preferably include a roller journaled onto an axle fitted through the carriage, with a lower edge or side of a section of the glass, or the like, maintained between upper sides of the carriage as a casing. The roller axle is arranged to fit through the channel flanges transverse slot, but will engage the undersurfaces of the flanges, to block travel of the roller out from between the channel flanges, should an attempt be made to lift the sliding door out of the lower track.

4 Claims, 1 Drawing Sheet

DOOR TRACK AND ROLLER SYSTEM

BACKGROUND OF THE INVENTION

1. Field of the Invention

This invention relates to door track and roller systems for a sliding door and frame to prohibit an unwanted removal ofthe sliding door out of the door track as by a person lifting it therefrom, and is useful for sliding doors generally from building sliding doors to sliding door as are used in merchandise showcases, and the like.

2. Prior Art

Sliding doors are commonly used for covering openings in buildings, as well as in to retail store display cases or showcases that incorporate glass front, side and even back walls to prominently display products, for example. Such sliding glass doors, however, generally suffer from a like problem or deficiency in that, even when locked to one another, or to a frame surface, a person seeking access can often lift the door top edge into an upper track, and displace the door lower edge out of a lower track, that can then be rotated away from that lower track, allowing the door to be removed. The present invention remedies such problems by a utilization of a lower door track that includes at least one track section that has an opening between flanges that are inwardly bent edge portions of channel sides top edges, with the door to travel in the opening between which flanges and incorporates door roller assemblies where each roller of the an assembly is journaled to an axle that extends beyond the sides of a sliding door carriage. The axle ends to block passage of the roller assembly up through the opening between the door track opposing flanges, prohibiting the sliding door from being lifted out of the door track.

Heretofore arrangements have been employed to guide rollers that are journaled to a sliding door along a frame mounted track, and examples of such are shown in U.S. Pat. No. 1,444,349; to Leeds, U.S. Pat. No. 1,956,651; to Moran, U.S. Pat. No. 4,633,615; to Moose, and U.S. Pat. No. 4,833,829, to Wilson, which, Leeds, Moose and Wilson patents have also provided for maintaining a roller of the assembly within a track, so as to prohibit lifting of the roller out from that track when the door is closed. Such arrangements, however, have not involved a use of a roller axle whose ends engage flanges of a track to prohibit lifting of the roller therethrough as does the invention. Similarly, a U.S. Pat. No. 5,488,803, to George, includes side walls wherebetween a roller is journaled and includes terminal portions to extend partially around a round track that the roller travels along, and a U.S. Pat. No. 3,693,293, et al., to Egan, Jr., shows a frame whereacross a roller is journaled that is contained between walls of a frame housing and includes right angle side walls edges that extend outwardly and are maintained in and below inwardly directed flanges of a track. The respective side wall edges and track flanges of the George and Egan, Jr., et al. patents, however, are only to guide travel of a door roller assembly along the track and door removal would appear to be possible if the door and roller where canted relative to the track whereon the roller rests. Further, of course, the structure of these patents is unlike that of the roller and axle arrangement and track flanges of the present invention.

While the above show an assortment of sliding door arrangements for mounting door rollers to rest on and travel along tracks, and several thereof show arrangements for discouraging lifting of the sliding door out of the track, none, however, shown a roller axle arrangement and track side walls with inturned flange arrangement like that of the invention. Whereby, a simple and reliable roller assembly and track to prohibit lifting of a locked sliding door out of its track is provided by the invention.

BRIEF SUMMARY OF THE INVENTION

It is a principal object of the present invention in a door track and roller system to provide an arrangement for prohibiting unwanted lifting of a sliding door out of its track.

Another object of the present invention in a door and track roller system is to provide a roller for arrangement as a lower roller system of a sliding door for easy and convenient installation in a sliding door bottom track that is mounted in a frame.

Still another object of the present invention in a door and track roller system is to provide a combination of a roller axle and lower track having inturned flanges that allow for travel of the sliding door in the opening between the track flanges and to prohibit a lifting of the roller and axle out of the lower track.

In accordance with the above objects, the invention in a door and track roller system includes a lower track for mounting as a lower or bottom frame of a sliding door, such as a patio door, as is used in a dwelling, or for a cabinet or display case, or the like. The lower track is preferably formed as a channel with the web thereof for mounting in a bottom portion of a frame, and the channel track wall top portions are inturned, forming flanges, with the distance between which flange edges is narrower than the length of a roller axle, or axle extension, that each roller of a roller system is journaled onto. Which axle is maintained to a carriage that is mounted or secured as an extension of a lower or bottom edge of a door. The bottom track flanges include at least one transverse slot formed across the flanges, spanning the opening therebetween, and proximate to a track end. The flange slot has a length to accommodate passage of the roller axle or axle extensions therethrough, with the roller surface for engaging for traveling along the track bottom as the door is urged therealong, to where a following roller axle will align with to pass through the slot as the door is passed along the track. With the door rollers installed in the lower track and fitted into a top track, the sliding door can be moved freely along the track.

Other objects and features of the invention will become apparent from the following detailed description in conjunction with the drawings disclosing what is presently contemplated as being the best mode of the invention.

DESCRIPTION OF THE DRAWINGS

In the drawings that illustrate that which is presently regarded as the best mode for carrying out the invention.

DETAILED DESCRIPTION

Figure 1:
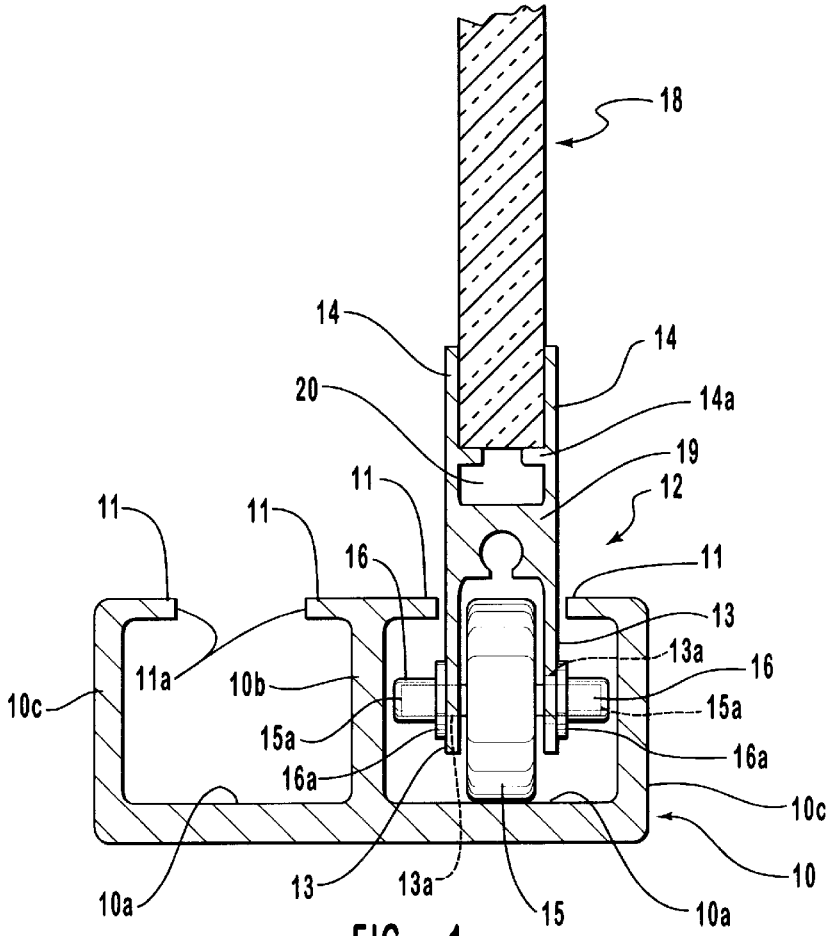
FIG. 1 is an end elevation view of a double lower or bottom track of a sliding door, with the sliding door shown as a section that includes a roller carriage as a lower extension of a door casing, across which carriage a roller axle is fitted with a roller journaled thereon, and which axle ends are shown capped with axle extensions.
Figure 2:
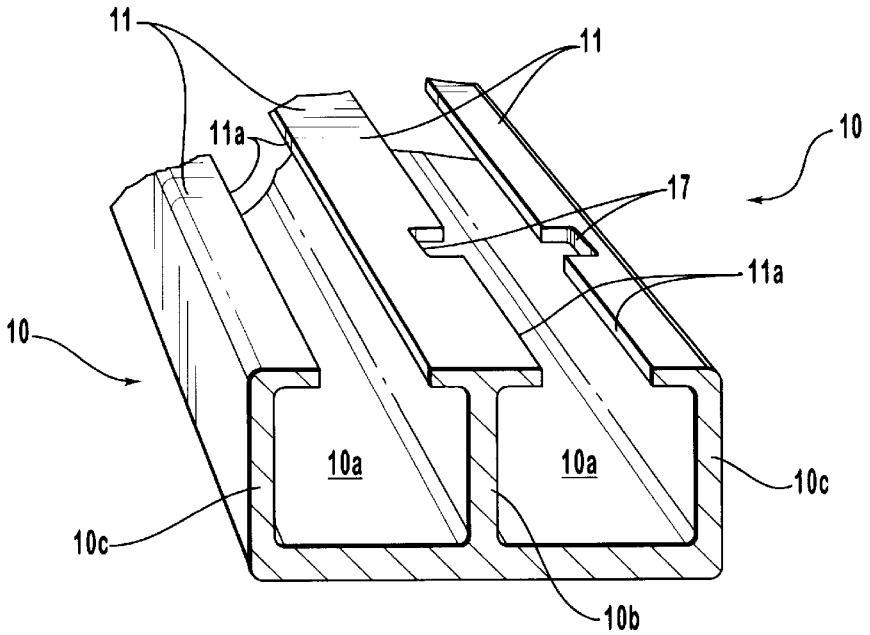
FIG. 2 is an end perspective view of the double lower door or bottom track and showing the track as a pair of channels that include a common side wall, with the channels having parallel common and outer side walls that include inturned top edges with a transverse slot formed in one pair of flanges that the roller axle or axle extensions of FIG. 1 will pass through for installing a carriage roller assembly in the track.

FIG. 1 shows a roller system 12 of the invention positioned in a section of a channel of a door track 10, that is shown as a double track in both FIGS. 1 and 2. The double track 10 includes identical channel sections that have a common inner side wall 10*b*, with identical bottom surfaces 10*a* and parallel outer side walls 10*c*. The respective outer side walls 10*c* and the common inner side wall 10*b*, as shown, include inwardly directed flanges 11, with flange 11 shown formed across the top edge of the inner side wall 10*b*. So arranged, a gap or space is provided between the ends or edges of the pair of flanges 11 of each channel section that will accommodate a carriage 19 traveling therealong. The carriage, as shown in FIG. 1, includes parallel side walls 14 that are formed as extension of a top end that accommodate a lower edge portion of a section or pane of glass 18, or the like, maintained therein. The glass section 18 edge surface is shown resting on a base surface 14*a* that extends across the base of side walls 14, forming a channel. A slot 20 is formed in that base surface 14*a* that is to receive an adhesive, or the like, for mounting the glass 18 lower edge portion in the carriage 19 channel. Additionally, the carriage 19 includes parallel identical lower side walls 13 as extensions of parallel sides of the carriage that each include an axle hole 13*a* formed therethrough. The axle holes 13*a* are aligned whith one another, with each axle hole to receive an end portion of a roller 15 axle 15*a*, as shown in broken lines beneath each of a pair of axle end caps 16.

As set out above, the roller 15 of carriage 19 is journaled on axle 15*a* to turn between the carriage lower side walls 13, with each roller 15 to roll along the track bottom surface 10*a*, as shown in FIG. 1. In practice the roller assembly includes at least a pair of spaced carriages 19 that each include a roller 15, and the roller assembly may include as many carriages with roller combinations as are appropriate to support the door with glass 18 therein, within the scope of this disclosure, as the glass door travels along one track section of the double track 10.

As shown in FIG. 1, the roller axle 15*a* is journaled through the roller 15 and is passed through the aligned holes 13*a* that are formed through the carriage lower side walls 13 with the axle 15*a* end portions to extend beyond the outer surfaces of with side walls 13. While, for the invention, the axle 15*a* end portions may be uncovered, in FIG. 1 the axle 15*a* end portions are shown as including end caps 16. End caps 16 are shown as cylinders that are closed across their outer ends and extend at right angles from an end collar 16*a*. The end collars 16*a* secured to the outer surfaces of the carriage lower side walls 13, around each axle hole 13*a*. The axle 15*a* end portions, or the combination of the axle 15*a* end portions are contained within the end caps 16, that are shown open longitudinally, exposing axle 15*a* ends. The axle 15*a*, with or without end caps 16, provides a straight rod having a greater length than the distance between the flange 11 ends or edges, as shown in FIG. 1, thereby blocking lifting of the roller assembly out of the single track section of the double track 10. So arranged, the sliding door, that includes the glass section 18 or the like, with carriages 19 that include a roller assembly 12 cannot be lifted out of the single track of the double track 11, unless a roller 15 and roller axle 15*a* is in alignment with flange slot 17. Each single track section of the double track 10, as shown in FIG. 2, includes one of the transverse slots 17 that are formed in opposing track flanges to align, and with each slot to have a sufficient length to pass the end portion of the roller axle 15*a*, that includes an end cap 16 fitted thereon. In practice, for fitting the sliding door into a single track of the double track 10, as shown in FIG. 1, a double track end is open to receive an end of the sliding door fitted therein, as, for example, before the track is mounted in a frame. However, where the track end is closed or there in insufficient room to pass one end of the sliding door into a track open end, a first carriage 19 of the roller assembly 12 roller axle 15*a* is lowered through the single track slot 17 and the sliding door first carriage 19 roller 15 is urged along the track section. The first roller 15 then rolls along the single track bottom surface 10*a* until a following carriage 19 of the roller assembly 12 is positioned over the transverse slot 17. Whereat the roller axle 15*a* is lowered therein and the sliding door is then further urged along the single track section until a next roller 15 of a carriage 19 aligns with the transverse slot 17. That roller 15 axle 15*a* is lowered therein, and so on, until the sliding door is fully mounted in the single track section of the double track 10.

Although a preferred form of my invention in a sliding door track and roller system has been shown and described herein, it should be understood that the present disclosure is made by way of example only and that variations are possible without departing from the subject matter coming within the scope of the following claims and a reasonable equivalency thereof, which subject matter I regard as my invention.

I claim:

1. A door track and roller system for mounting a sliding door in a frame comprising, a pair of like straight sections of channel connected together along a common inner side as a double track for mounting in a bottom of a sliding door frame with each said section of channel having a bottom surface said innner side, and a parallel outer side, said sides having top edges that are inturned towards one another as flanges each said section of channel being open between ends of said flanges and including at least one transverse slot formed in each said flange, intermediate said straight channel ends, which said slots align across said channel opening, to pass a roller axle fitted therethrough; and a sliding door roller assembly that includes a pair of carriage assemblies that each include at least a roller that is journaled onto a roller axle with said roller axle fitted through aligned holes formed through lower side walls of h said carriage assembly, and which said roller axle is a straight shaft having a length to pass through and extend beyond the aligned holes formed in the carriage assembly lower side walls, said roller axle fitting through said at least one transverse slot formed in each said flange with each said carriage assembly maintained, at a top end, to a sliding door casing lower end, to a sliding door casing lower end.

2. A door track and roller system as recited in claim 1, wherein the bottom surface of each of the sections of channel is flat.

3. A door track and roller system as recited in claim 1, wherein the carriage means includes, a sliding door casing comprised of a pair of parallel spaced top walls as extensions of opposite edges of a top surface of a rectangular body, which said spaced top walls receive a bottom edge of a section of glass mounted therein, with the carriage assembly lower side walls formed as extensions of the sides of said rectangular body.

4. A door track and roller system as recited in claim 1, further including end cap means for securing, in covering arrangement over the roller axle ends, and for mounting onto the outer surfaces of the carriage assembly lower side walls, around the holes formed therethrough, which said cap means will fit through said at least one transverse slot formed in each said flange.

* * * * *